US005458341A

United States Patent [19]

Forrest et al.

[11] Patent Number: 5,458,341

[45] Date of Patent: Oct. 17, 1995

[54] ARROW TIP FOR HUNTING

[76] Inventors: Richard M. Forrest, 8195 E. Nicaragua, Tucson, Ariz. 85730; James Casady, 8015 N. Suwannee Dr., Tucson, Ariz. 85741

[21] Appl. No.: 250,015

[22] Filed: May 27, 1994

[51] Int. Cl.[6] ..... F42B 6/08

[52] U.S. Cl. ..... 273/421

[58] Field of Search ..... 273/416, 419, 273/420, 421, 422; D22/115

[56] References Cited

U.S. PATENT DOCUMENTS

| | | | |
|---|---|---|---|
| D. 279,813 | 7/1985 | Palizzolo | D22/115 |
| 2,568,417 | 9/1951 | Steinbacher | 273/421 |
| 4,781,386 | 11/1988 | Armitage | 273/422 |
| 5,102,147 | 4/1992 | Szeluga | 273/422 |
| 5,178,398 | 1/1993 | Eddy | 273/421 |
| 5,178,399 | 1/1993 | Garoutte | 273/422 |

*Primary Examiner*—Paul E. Shapiro
*Attorney, Agent, or Firm*—Ogram & Teplitz

[57] ABSTRACT

An improved arrow tip suitable for hunting and an arrow assemblage associated therewith. The arrow tip has a tapered main body with four slots therein. Two fixed blades 180 degrees apart, are secured at the rear of the main body and at a swivel point; these fixed blades are removable, permitting the user to create a two blade embodiment by removing the fixed blades. Two angled or L-shaped blades are swivelly attached, at the swivel point, to the main body member such that the longer leg of the angled blades is contained within the slots during in-flight. The shorter leg of the angled blade is exposed during in-flight; but, upon impact and penetration, the shorter leg encounters resistance from the flesh of the animal, thereby swiveling the longer leg from the protection of the slot, and exposing the cutting edge the longer leg. The longer leg's more lethal cutting edge creates extensive bleeding in the animal and thereby causes a faster and more humane death.

22 Claims, 4 Drawing Sheets

ARROW TIP FOR HUNTING

BACKGROUND OF THE INVENTION

This invention relates generally to archery equipment and more particularly to hunting tips for arrows.

The bow and arrow has been around since the stone-age and is reflective of how Man's tool making ability has, and will, give him a survival edge. In modern times, the bow is no longer viewed as a necessary component for survival but has taken on more of a recreational stand. Like its predecessors, the modern arrow is used to kill prey by causing bleeding and hemorrhage within the animal. The basic axiom is that the more bleeding the arrow causes, the more lethal the arrow.

To this end, a wide variety of arrowheads have been developed which seek to increase the cutting aspect of the arrowhead. These include: U.S. Pat. No. 5,078,407, entitled "Expandable Blade, Composite Plastic, Broadhead Hunting Arrow Tip" issued to Carlston et al. on Jan. 7, 1992; U.S. Pat. No. 5,090,709, entitled "Arrowhead with Extendable Blades" issued to Johnson on Feb. 25, 1992; U.S. Pat. No. 4,940,246, entitled "Arrow Attachment" issued to Stagg on Jul. 10, 1990; U.S. Pat. No. 5,046,744, entitled " Hunting Point for Arrows" issued to Eddy on Sept. 10, 1991; U.S. Pat. No. 3,915,455, entitled "Removable Very Sharp Quality Cutting Blades Extending From Very Near by the Tip to the Arrow Shaft" issued to Savora; U.S. Pat. No. 3,578,328, entitled "Arrowhead with Pivoted Blades" issued to Rickey on May 11, 1971; U.S. Pat. No. 4,268,038, entitled "Accessory for an Arrow" issued to Wierenga on May 19, 1981; U.S. Pat. No. 3,910,579, entitled "Swivel-Mounted Hunting Arrowhead" issued to Sprandel on Oct. 7, 1975; and, U.S. Pat. No. 4,111,424, entitled "Arrow and Arrow Attachment" issued to Schrieiber et al., on Sep. 5, 1978.

In all of these situations, the devices attempt to create more cutting edges to contact the flesh of the targeted animal. While this does increase the effective kill potential for arrows that strike their target, the designs of these devices create new air-foils causing some arrows to veer off or to catch slight breezes forcing the arrow off its "mark"; missing the animal altogether.

It is clear from the foregoing that there is a need for an aerodynamic arrow head that flies true but which can cause the maximum cutting at impact.

SUMMARY OF THE INVENTION

The invention is an improved arrow tip suitable for hunting and an arrow assemblage associated therewith. The arrow tip has a aerodynamic tapered main body with four slots therein.

Two angled or L-shaped blades are swivelly attached to the main body member with two triangular shaped blades fixed at ninety degrees to the L-shaped blade and attached to the main body member providing for a four blade arrow head configuration. The fixed blades are attached such that they can be removed and provide an optional two blade arrow head configuration consisting solely of the L-shaped blades.

The angled blades are attached such that the longer leg of the angled blades is contained within the slots during in-flight. The shorter leg of the angled blade is left exposed during in-flight; upon impact and penetration, the shorter leg encounters resistance, thereby pulling the longer leg from the protection of the slot, exposing the cutting edge of the longer leg. The longer leg's cutting edge creates extensive bleeding in the animal which causes a faster and more humane death.

In this manner, the main cutting blades, which eventually extend up to an inch and half or more from the body member, are kept secure during the in-flight stage so that they do not interfere with the flight of the arrow. Only upon impact, when the shorter legs contact the animal, are the longer cutting blades withdrawn and brought to bear upon the prey.

A further advantage of the present invention is the addition of the fixed blades which are short (not extending the full length of the main body) thus maintaining the arrow head aerodynamic qualities. To achieve this, the invention, in the preferred embodiment, uses a new method of fixed blade retention which uses the swivel point of the L-shaped blades as the frontal attachment point for each fixed blade.

In an alternative embodiment, a fixed pin perpendicular to the fixed blade slot and positioned approximately at the midsection of the main body is used to retain the short fixed blade.

The use of a collar or ring keeps the long blade within its slot/sheath during flight. This ring is preferably made of a heat-shrink material well known in the art so that the long blades are "locked" in place during manufacture, thereby reducing the hazard level for the user.

Other materials are also available which serve this function and are well known to those of ordinary skill in the art, including, but not limited to: rubber bands, string, and the like.

These constriction bands are kept in place using a notch extending the circumference of the body member. Preferably this notch is directly in front of the shorter cutting blade when the longer cutting blade in within the slot.

In operation, the constricting band is cut or broken during entry into the targeted animal, thereby releasing the long cutting blade for its purpose.

In an alternative embodiment, the collar ring is replaced with a sheer pin, preferably made from rubber, which extends through the body member and through both of the angle blades to maintain the longest leg of the angle blades protected within the slot. The sheer pin breaks or sheers as pressure on the shorter blades increases significantly during penetration into the animal, forcing the angle blades to swivel.

The invention, together with various embodiments thereof, will be more fully explained by the accompanying drawings and the following descriptions.

DRAWINGS IN BRIEF

Figure 6A:
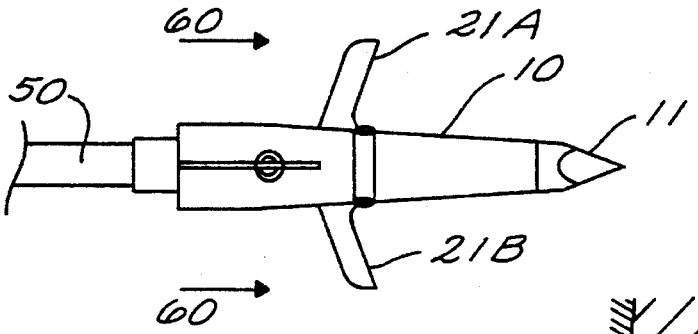
Figure 6B:
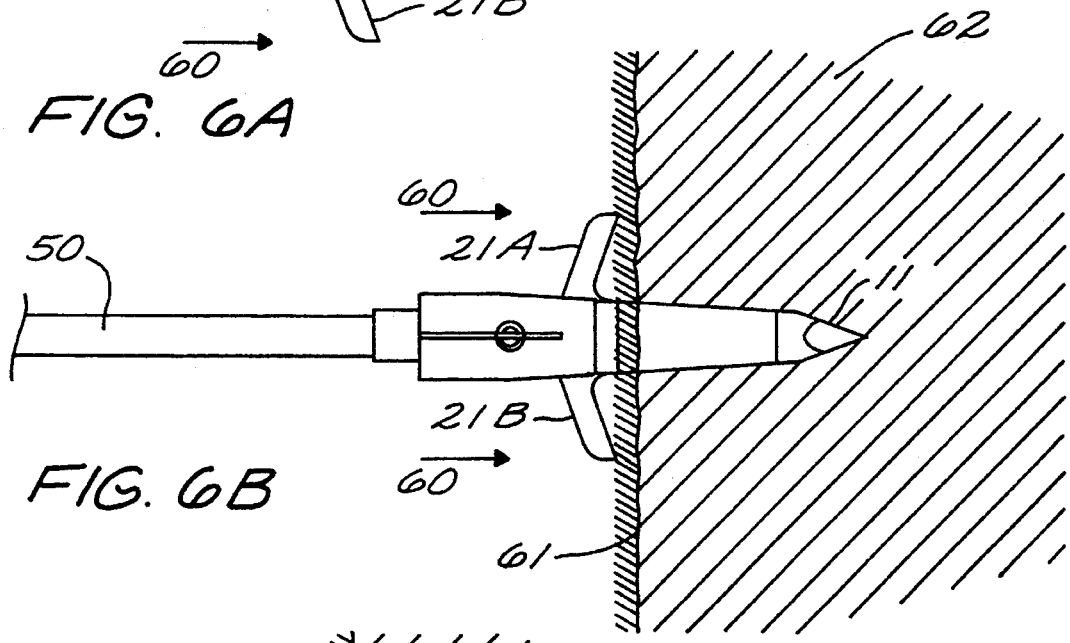
Figure 6C:
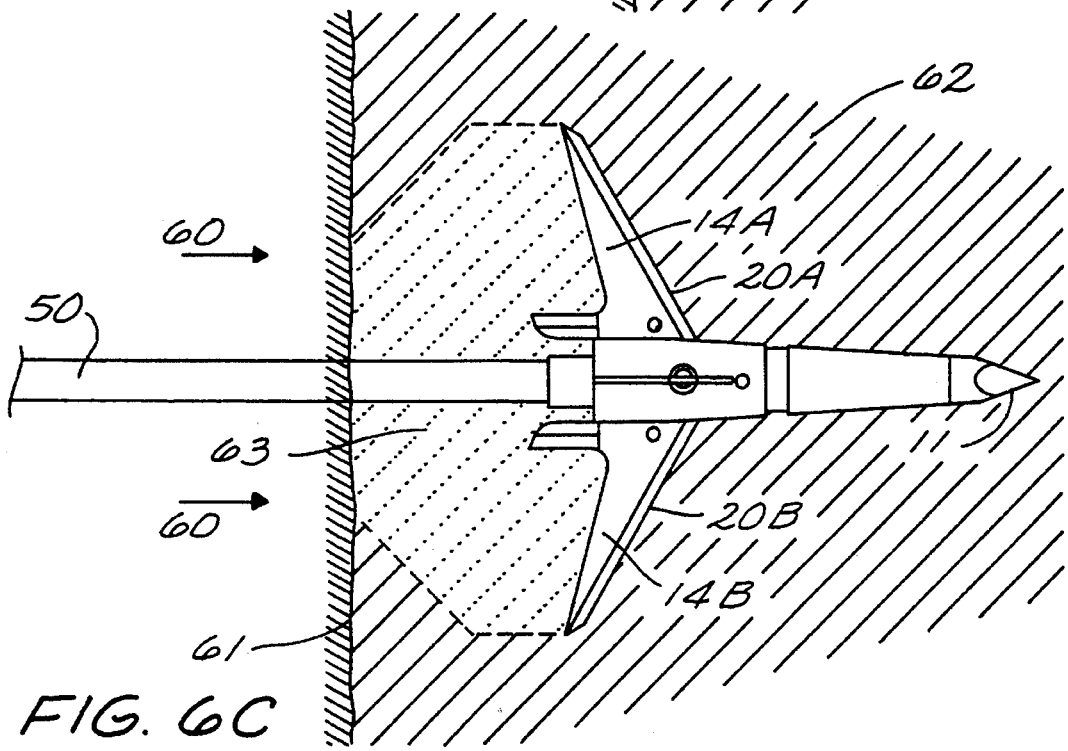

FIGS. 6A, 6B, and 6C are side views of the invention in-flight, upon penetration, and after penetration, respectively, of the arrowhead into a prey.

Figure 7A:
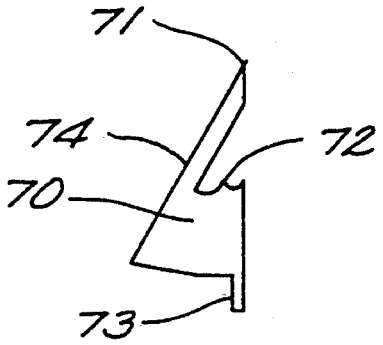

FIG. 7A is a side view of the preferred embodiment for the fixed blade of the arrow head.

Figure 7B:
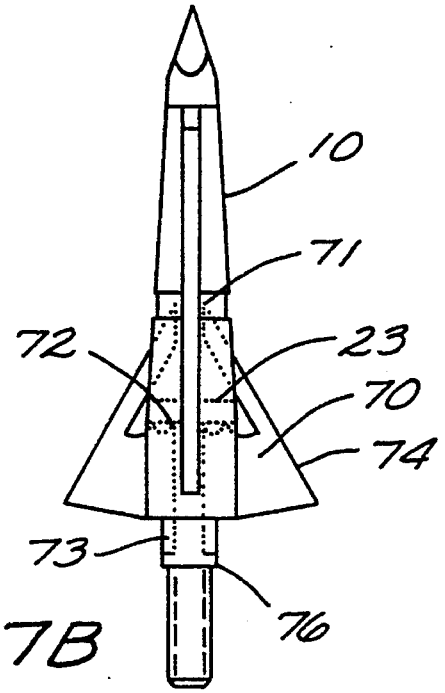

FIG. 7B is a side view of the preferred fixed blade attached to the arrow head.

Figure 8A:
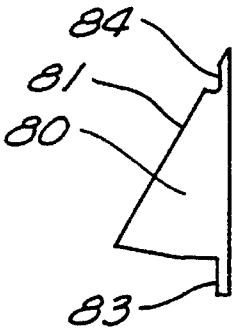

FIG. 8A is a side view of an alternative embodiment of the fixed blade of the arrow head.

Figure 8B:
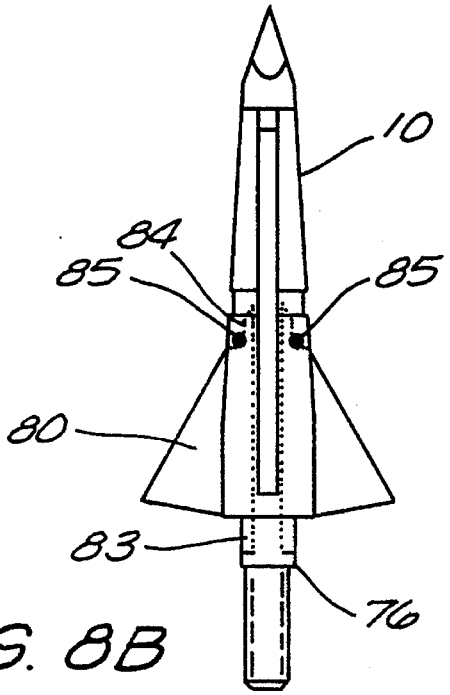

FIG. 8B is a side view of the alternative embodiment of the fixed blade attached to an arrow head.

DRAWINGS IN DETAIL

Figure 1A:
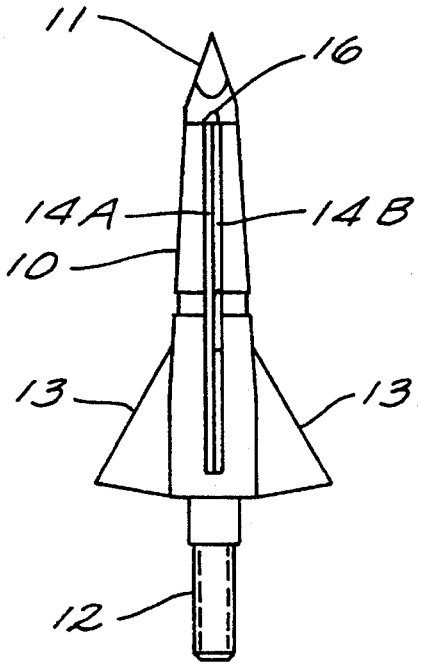
FIGS. 1A and 1B are side views of the preferred embodiment of the invention.
Figure 1B:
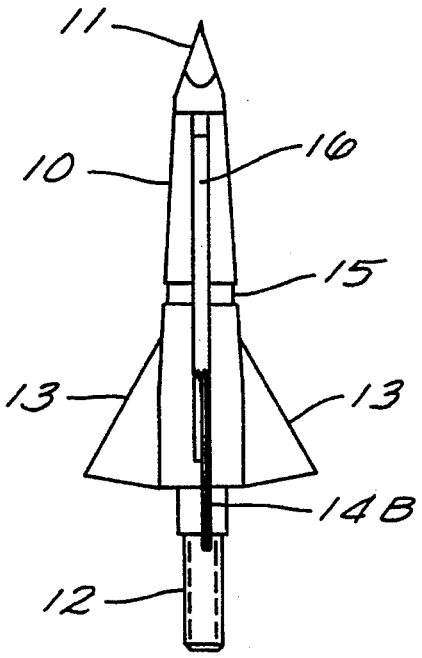

FIGS. 1A and 1B are side views of the preferred embodiment of the invention.

As shown in FIG. 1A, main body member 10 is sharpened at one end 11 to facilitate penetration of the arrowhead into the prey. At the other end, attachment means 12 permit the easy attachment of the arrowhead to an arrow shaft (not shown). A variety of devices exist for this attachment mechanism including adhesive bonding, screw mechanisms, and the like.

Fixed blades 13 in this embodiment are attached toward the rear of the body member 10. In the preferred embodiment, these blades are kept small so as not to affect the aerodynamics of the arrow with arrowhead.

The longer sides angular blades 14A and 14B are contained within slot 16 during flight or storage (as shown in FIG. 1A).

FIGS. 1B shows the same angle of the preferred arrowhead of FIG. 1A except that in this case, the longer angular blades have been rotated outward after impact and penetration. Angular blade 14B has been rotated/swiveled from slot 16 to expose its sharpened cutting edge (not shown).

Note that in this embodiment, slot 16 extends clear through the main body member 10. Also note that cutting blades 13 and slot 16 are substantially at right angles to each other. This promotes stable flight and also ease in manufacturing.

Figure 2A:
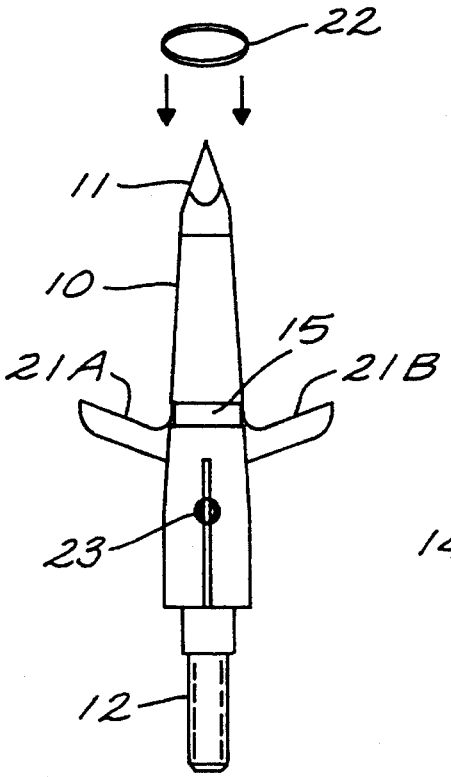
FIGS. 2A and 2B are side views of the preferred embodiment of the invention rotated ninety degrees from the view of FIGS. 1A and 1B respectively.
Figure 2B:
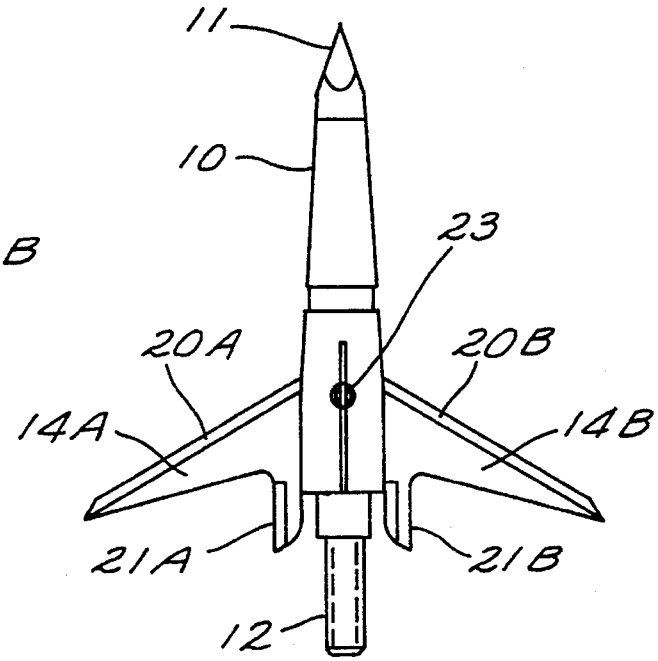

FIGS. 2A and 2B are side views of the preferred embodiment of the invention rotated ninety degrees from the view of FIGS. 1A and 1B respectively.

As shown in FIG. 2A, body member 10 has point 11 and attachment means 12. Swivel connector 23 engages the angular blade. The shorter blade 21A and 21B are shown. The angular blade is secured in position in this preferred embodiment through the use of restraining ring 22 which fits over point 11 and is secured into notch 15 which circumvents the body member.

Restraining ring 22 holds the longer blades in the slot (as shown in FIG. 1A) but is broken upon impact and penetration of the arrowhead into the prey. Suitable materials for the construction of restraining ring 22 include rubber bands and string. In the preferred embodiment, a heat-shrinking material is used. In this preferred embodiment, the heat-shrinking ring is placed into the notch 15 and heated to contract securely into the notch 15.

Heat shrink material has been found to the preferred material since it is not susceptible to weather fatigue. Rubber bands and paper rings breakdown when exposed to weather and the sun; thereby, allowing the longer sharpen blades to be become exposed and creating a risk to the archer.

Upon impact and penetration, FIG. 2B, the constraining ring is broken by the long angular blades 14A and 14B, thereby exposing their sharpened edges 20A and 20B respectively. Note that the angular blade, composed of short blade 21A with long blade 14A, swivels around swivel point 23.

By comparing the in-flight arrowhead of figure 1B, to the penetrating arrowhead of FIG. 2B, it is clear that the extended long blades significantly increase the cutting surface of the arrow-head, yet, the in-flight arrowhead is extremely aerodynamic without undue surfaces to cause lift and mis-direction.

Figure 3:
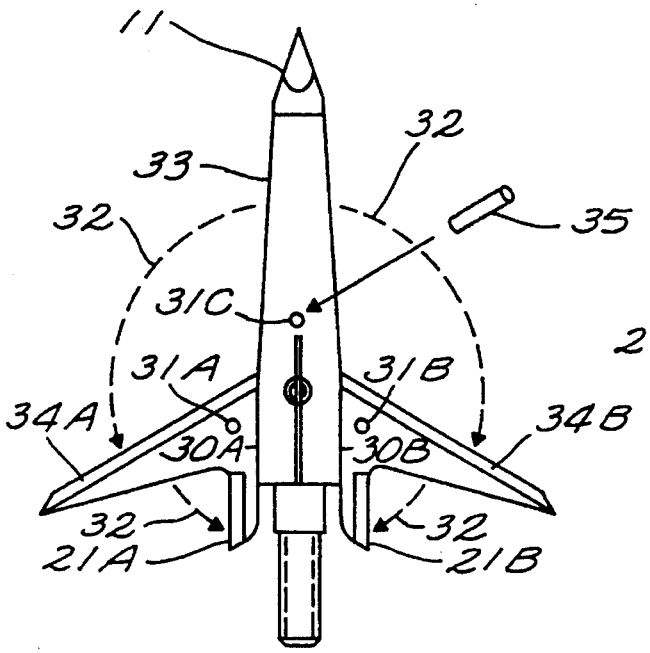
FIG. 3 is a side view of an alternative embodiment of the invention illustrating the rotating/swiveling of the angular blades.

FIG. 3 is a side view of an alternative embodiment of the invention illustrating the rotating/swiveling of the angular blades.

As the arrowhead 33 strikes and penetrates the prey, the short blades 21A and 21B contact the prey's flesh forcing the long blades, 34A and 34B, to swivel, as shown by dotted line 32, out of their slot until the shorter blades 21A and 21B contact the side of main body member 33 at 30A and 30B respectively.

This embodiment secures the long blades 34A and 34B in the slot through the use of a sheer pin 35 which extends through hole 31C in the main body member 33, hole 31A and 31B in the long blades 34A and 34B respectively. Sheer pin 35 is preferably constructed of a material which easily breaks upon impact and penetration of the arrowhead. Such materials include rubber, plastics, and the like.

Figure 4:
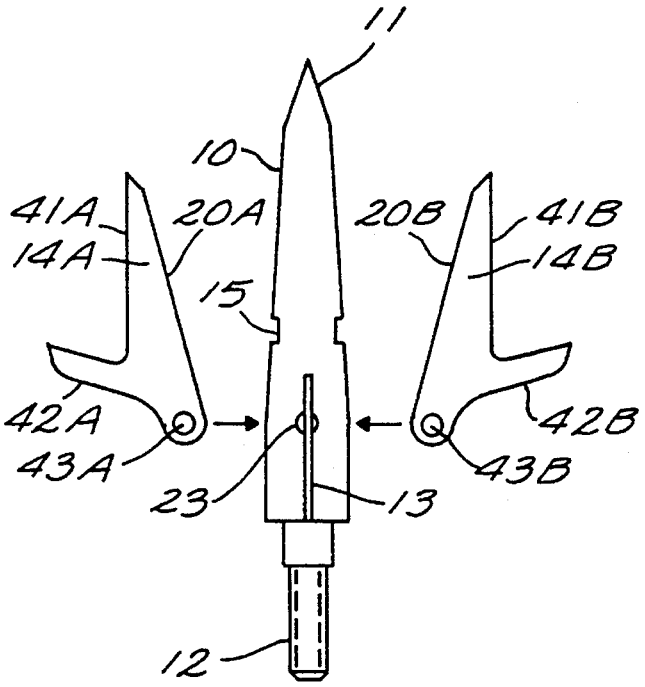
FIG. 4 is blow-up view of the preferred embodiment showing the structure of the angular blades.

FIG. 4 is blow-up view of the preferred embodiment showing the structure of the angular blades.

As noted relative to FIGS. 1A, 1B, 2A, and 2B, main body member 10 has a sharpened nose 11 with notch 15 therein, Swivel pin 23 is used to swivel the angular blades thereupon. Angular blades 14A and 14B are substantially L-shaped having long blades 41A and 41B with shorter blades 42A and 42B. During flight, long blade 41A and 41B are contained with the slot (not visible in this figure).

During assembly, holes 43A and 43B are aligned with swivel pin hole 23 for securement, thereby permitting the angular blades 14A and 14B to rotate therearound.

Figure 5:
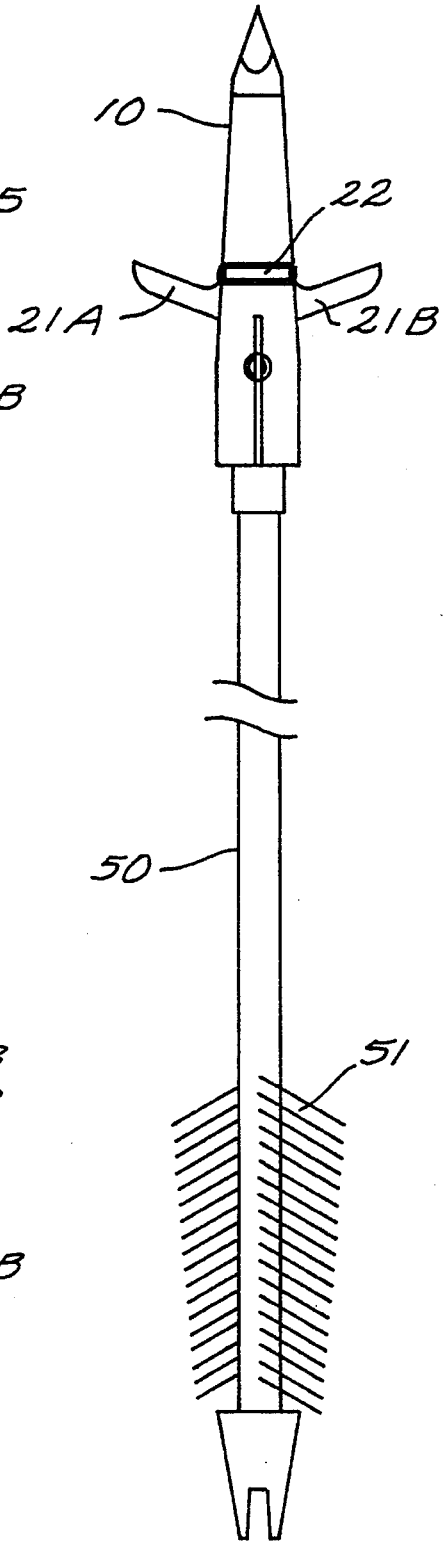
FIG. 5 is a side view of the preferred embodiment mounted onto an arrow.

FIG. 5 is a side view of the preferred embodiment mounted onto an arrow.

Arrow shaft 50 has attached to one end, fletchings 51 which assist in stabilizing the arrow in flight. At the other end is preferred arrowhead 10 with the smaller angular blades 21A and 21B exposed.

FIGS. 6A, 6B, and 6C are side views of the invention in-flight, upon penetration, and after penetration, respectively, of the arrowhead into a targeted prey.

During flight, FIG. 6A, as shown by arrows 60, the shorter blades 21A and 21B of the angular blade are exposed. Minimal disruption of the aerodynamic main body 10 is created by these blades during flight.

Upon impact, sharpened nose 11 pierces the skin 61 and enters the prey's flesh 62. As the shorter blades 21A and 21B continue in the direction 60, contact skin 61, the constricting band is broken (not shown). Skin 61, and flesh 62, press upon the shorter blades 21A and 21B, swiveling the longer blades into position (FIG. 6C) to cut a wider swath 63 through the flesh of the prey. This increased cutting, creates increased bleeding and hence is more lethal than the prior art.

Since the longer blades are not exposed until after they have entered the prey's body, they are not dulled or hampered by the prey's thick hide, fur, and any external dirt/mud on the animal. The longer blade's sharpness is maintained until its cutting capability is required.

FIG. 7A is a side view of the preferred embodiment for the fixed blade of the arrow head.

This embodiment of the fixed blade creates two points for securing the fixed blade to the main body. Blade 70 has a leading point 71 which is an extension of the cutting surface 74; and, in this embodiment does not contact the main body 10 but is free floating. Mid-point attachment 72 is shaped to engage the main body 10; back lock mechanism 73 is used to both secure blade 70 to the main body, not shown, but also to received compression pressure from the arrow shaft to press and hold blade 70 in the main body.

FIG. 7B is a side view of the preferred fixed blade attached to the arrow head.

Blade 70 is inserted into a slot in the main body 10 so that mid-point attachment 72 engages with receptacle 23.

Compression is supplied by screw mechanism 76 which both presses blade 70 forward (engaging leading point 71 with the slot slope; and mid-point attachment 72 with receptacle 23) and securing back lock mechanism 73 therein. In this manner, a single engaging action secures the fixed blade at two different locations.

In this context, the mid-point attachment 72 serves as an engagement mechanism which contacts, and engages, a engagement pin located within the slot. These mechanisms are engaged when pressure from the arrow shaft (not shown) presses against back lock mechanism 73 forcing the short blade 70 forward.

In the field, should the archer/hunter want to remove the fixed blades, simply by releasing the screw mechanism 76, the entire fixed blade is released and removed.

FIG. 8A is a side view of an alternative embodiment of the fixed blade of the arrow head.

In this embodiment, fixed blade 80 is affixed at two points, leading point 84, and trailing point 83. Cutting edge 81 does not extend all the way to leading point 84; rather, leading point 84 is configured to fit under pins provided in the main body.

FIG. 8B is a side view of the alternative embodiment of the fixed blade attached to an arrow head.

As with the other embodiment of the fixed blade, fixed blade 80 fits into a slot into the main body 10 such that leading point 84 engages one of pins 85. This engagement is secured by compression supplied to trailing point 83 by screw mechanism 76, which also secures the trailing point 83 to the main body.

Note attachment 84 serves as an engagement mechanism which contacts, and engages, a engagement pin located at a forward point within the slot. In the preferred embodiment, this engagement pin is also the pin used to provide the swivel to the L-shaped blades. The blade's mechanisms are engage with the pin when pressure from the arrow shaft (not shown) presses against back lock mechanism 83 forcing the short blade 80 forward.

Again, in the field, the removal of the fixed blade is simply a matter of releasing the pressure from screw mechanism 76 so that fixed blade 80 can be removed.

The screw mechanism 76 is any of those well known to those of ordinary skill in the art. Its function of providing compression pressure on the fixed blade and also retention of the trailing point 83 (back lock mechanism 73 of FIGS. 7A and 7B) is easily accomplished by a variety of mechanisms easily designed by those of ordinary skill in the art.

It is clear from the foregoing that the present invention creates a highly improved arrowhead which is both more aerodynamically sound and more lethal.

What is claimed is:

1. An improved hunting arrow comprising:

a) an arrow shaft;

b) fletchings attached to a first end of said arrow shaft; and, c) an arrow tip attached to a second end of said arrow shaft, said arrow tip having, 1) attachment means for securing said arrow tip to said arrow shaft, 2) an aerodynamic elongated body member secured to said attachment means at a first end thereof, a second end of said elongated body member being tapered to a point, said elongated body member having a first and second juxta-opposed slots therein, and wherein said elongated body member includes a hole therein, 3) two L-shaped blades, each of said L-shaped blades being swivelly connected to said elongated body member such that a longer leg of said L-shaped blades is containable within one of said slots, each of said L-shaped blades containing a hole therein, said holes in said L-shaped blades communicating with the hole in said elongated body member, 4) restraining means comprising a sheer member positioned in the holes in said elongated body member and both of said L-shaped blades for maintaining said longer leg of said L-shaped blades within one of said slots such that substantially upon contact with a target, said restraining means is broken by said L-shaped blades, and, 5) two rigid blades, each rigid blade attached to said elongated body member substantially at right angles to said slots.

2. The improved hunting arrow according to claim 1 wherein selected edges of said L-shaped blade are sharpened.

3. The improved hunting arrow according to claim 1 wherein said slots communicate with each other.

4. The improved hunting arrow according to claim 3 wherein a shorter leg of said L-shaped blades restrict a range of swivel of said L-shaped blades.

5. The improved hunting arrow according to claim 1 wherein said main body includes two slots for receipt of said rigid blades and means for engaging said rigid blades in said main body.

6. The improved hunting arrow according to claim 5 wherein said means for engaging includes means for pressing said rigid blades at a trailing point of said rigid blades.

7. An improved arrow tip comprising:

a) attachment means for securing said arrow tip to an arrow shaft;

b) an elongated body member secured to said attachment means at a first end thereof, a second end of said elongated body member being tapered to a point, said elongated body members having a first and second juxta-opposed slots therein; and, c) two L-shaped blades, each of said L-shaped blades being swivelly connected to said elongated body member such that a longer leg of said L-shaped blades is containable within said slot; and, d) a constraining strap composed of a heat-shrink material positioned around said elongated body member for securing the longer leg of said L-shaped blade within said slot.

8. The improved arrow tip according to claim 7 further including two rigid blades, each rigid blade attached to said elongated body member substantially at right angles to said slots.

9. The improved arrow tip according to claim 8 wherein selected edges of said L-shaped blade are sharpened.

10. The improved arrow tip according to claim 9 wherein said slots communicate with each other.

11. The improved arrow tip according to claim 8 wherein said main body includes two slots for receipt of said rigid blades and means for engaging said rigid blades in said main body.

12. The improved arrow tip according to claim 11 wherein said means for engaging includes means for pressing said rigid blades at a trailing point of said rigid blades.

13. A hunting arrow tip comprising:

a) a body member tapering from a first end to a pointed second end, said body member have two slots therein;

b) two angled blade members, each angled blade member having a long blade portion and a short blade portion arranged at an angle to each other, each of said angled blade members being swivelly attached to said body member such that, 1) in flight, the long blade portion is enclosed in one of said slots and the short blade portion is exposed, and, 2) upon impact and penetration, the short blade portion contacts body parts of an animal, forcing the long blade portion to swivel from said slot, thereby exposing a forward facing cutting edge of said long blade portion against body parts of the animal;

c) attachment means connected to said first end of said body member for securing said hunting arrow tip to an arrow; and d) a constraining strap composed of a heat-shrink material positioned around said elongated body member for securing the long leg portion of said L-shaped blade within said slot.

14. The hunting arrow tip according to claim 13 wherein said slots are on opposite sides of said body member.

15. The hunting arrow tip according to claim 14 wherein said slots communicate with each other.

16. The hunting arrow tip according to claim 14 further including two cutting blades, said cutting blades located proximate to said first end of said body member and at right angles to said slots.

17. The hunting arrow tip according to claim 16 wherein said main body includes two slots for receipt of said cutting blades and means for engaging said cutting blades in said main body.

18. The hunting arrow tip according to claim 17 wherein said means for engaging includes means for pressing said cutting blades at a trailing point of said cutting blades.

19. An improved arrow tip comprising:

a) a main body having, 1) a sharpened first end, 2) means for attaching the main body to an arrow shaft located at a second end thereof, and, 3) at least two shorten slots extending substantially half way up said main body and juxtaposed towards the second end, each of said shorten slots having an engagement pin; and, b) at least two rigid blades, each of the rigid blades having a pin engagement mechanism and being positioned in one of said shorten slots such that pressure from an arrow shaft engaging said means for attaching forces said engagement mechanism against said engagement pin.

20. The improved arrow tip according to claim 19 wherein said engagement mechanism is located along one edge of said rigid blades.

21. The improved arrow tip according to claim 19 wherein said engagement mechanism is located at a leading point of said rigid blades.

22. The improved arrow tip according to claim 19 wherein said body member has two additional slots and further including, two angled blade members, each angled blade member having a long blade portion and a short blade portion arranged at an angle to each other, each of said angled blade members being swivelly attached to said body member such that, a) in flight, the long blade portion is enclosed in one of said additional slots and the short blade portion is exposed, and, b) upon impact and penetration, the short blade portion contacts body parts of an animal, forcing the long blade portion to swivel from said slot, thereby exposing a forward facing cutting edge of said long blade portion against body parts of the animal.

* * * * *